US011047550B1

(12) United States Patent
Tseng et al.

(10) Patent No.: US 11,047,550 B1
(45) Date of Patent: Jun. 29, 2021

(54) ELECTRONIC DEVICE

(71) Applicant: ASUSTeK COMPUTER INC., Taipei (TW)

(72) Inventors: Chun-Mao Tseng, Taipei (TW); Chien-Yi Huang, Taipei (TW); Chao-Shun Wang, Taipei (TW); Min-Che Kao, Taipei (TW); Min-Hung Chang, Taipei (TW); Lu-Chien Chen, Taipei (TW); Hui-Fang Yan, Taipei (TW); Yi-Nian Zou, Taipei (TW); Min-Yu Wu, Taipei (TW); Hao-Yen Chang, Taipei (TW); Li Ding, Taipei (TW); Chi Liu, Taipei (TW); Yu-Jen Chen, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/106,255

(22) Filed: Nov. 30, 2020

(30) Foreign Application Priority Data

Dec. 13, 2019 (CN) ..... 201911281753.3

(51) Int. Cl.
*F21V 11/14* (2006.01)
*F21K 9/61* (2016.01)
*F21Y 105/16* (2016.01)

(52) U.S. Cl.
CPC ..... *F21V 11/14* (2013.01); *F21K 9/61* (2016.08); *F21Y 2105/16* (2016.08)

(58) Field of Classification Search
CPC ..... F21V 11/08–14; G02B 6/0051; G02F 1/133603
See application file for complete search history.

(56) References Cited

U.S. PATENT DOCUMENTS

2012/0218752 A1* 8/2012 Sumitani ..... G02F 1/133605 362/235

FOREIGN PATENT DOCUMENTS

CN 201348177 U 11/2009
CN 204901681 U 12/2015

* cited by examiner

*Primary Examiner* — Sean P Gramling
(74) *Attorney, Agent, or Firm* — McClure, Qualey & Rodack, LLP

(57) ABSTRACT

The electronic device provided includes a housing with two first through holes and two second through holes, a light guiding structure, and a light source. A first section is provided between the two first through holes, and a second section is provided between the two second through holes. The length of the first section is less than the length of the second section. The light guiding structure includes a light guiding layer, a diffusion layer, and a light adjusting layer. The light adjusting layer is disposed at the position of the first section. The light source is disposed at a position that corresponds to an intersection of the first section and the second section. Light emitted by the light source passes through the light transmitting portion and the intersection, and is separately emitted through the first through holes and the second through holes along the light transmitting portion.

9 Claims, 4 Drawing Sheets

ELECTRONIC DEVICE

CROSS-REFERENCE TO RELATED APPLICATION

This application claims the priority benefit of Chinese Application Serial No. 201911281753.3, filed on Dec. 13, 2019. The entirety of the above-mentioned patent application is hereby incorporated by reference herein and made a part of specification.

BACKGROUND OF THE INVENTION

Field of the Invention

The disclosure relates to an electronic device, and in particular, to an electronic device including a light effect.

Description of the Related Art

With the development of electronic devices, users require more than merely the operation performance of electronic devices. Therefore, commercially available electronic devices are provided with light effects to meet requirements of different users.

To perform light effect on the surface of an electronic device, a plurality of light emitting holes are usually provided in a housing of an electronic device. A plurality of light sources are disposed in the electronic device to emit light through the light emitting holes. The quantity of the light sources corresponds to a quantity of the light emitting holes. During use, the light sources are controlled to enable light to generate different light effects. However, the quality of light effects is related to the distribution density of emitted light. When the distribution density of emitted light is excessively low, the light effects is poor. Therefore, when the density and quantity of light emitting holes are increased in the electronic device to improve the light effects, the quantity of light sources also needs to be increased accordingly. As a result, the costs of the electronic device are increased, and the increased quantity of the light sources tend to cause overheating in the electronic device.

BRIEF SUMMARY OF THE INVENTION

The disclosure provides an electronic device, including a housing, a light guiding structure, and a light source. The housing includes two first through holes and two second through holes. A first section is provided between the two first through holes, and a second section is provided between the two second through holes.

The length of the first section is less than the length of the second section, and the first section and the second section intersect at an intersection. The light guiding structure is disposed on a side of the housing, and includes a light guiding layer, a diffusion layer, and a light adjusting layer.

The light guiding layer includes a light transmitting portion and a light shielding portion. The position of the light transmitting portion corresponds to the positions of the first section and the second section. A portion other than the light transmitting portion is the light shielding portion, and the light transmitting portion includes a first light transmission rate.

The diffusion layer is disposed at the position corresponding to the light transmitting portion. The light adjusting layer is disposed at the position corresponding to the first section. The light adjusting layer includes a second light transmission rate, and the second light transmission rate is less than the first light transmission rate.

The light source is disposed at a position that is on a side of the light guiding structure and corresponds to the intersection. Light emitted by the light source passes through the light guiding structure and the intersection, and is separately emitted through the two first through holes and the two second through holes along the light transmitting portion.

DETAILED DESCRIPTION OF THE EMBODIMENTS

Figure 1:
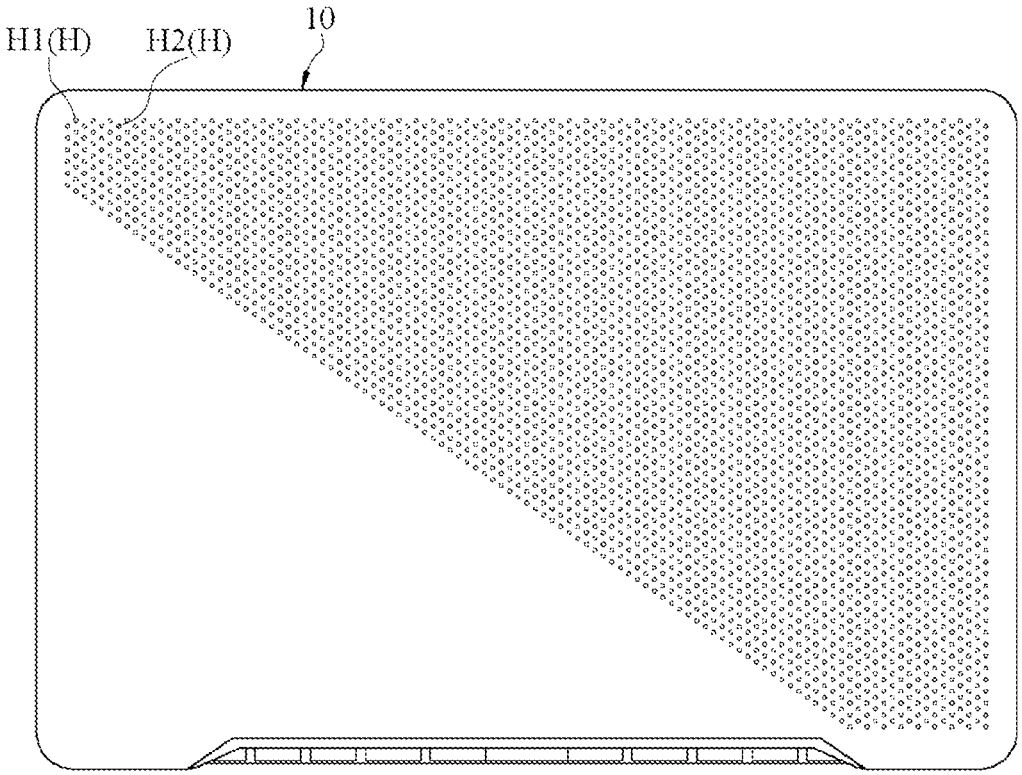
FIG. 1 is a schematic outside view of an embodiment of an electronic device according to the disclosure.
Figure 2:
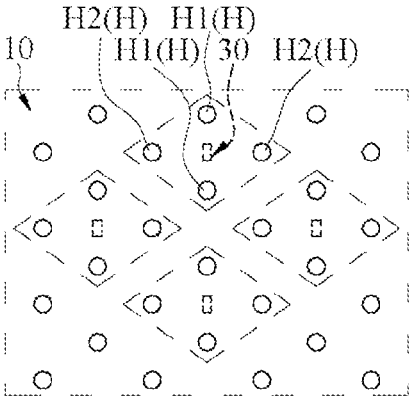
FIG. 2 is a partial planar outside view of an embodiment of an electronic device according to the disclosure.

FIG. 1 is a schematic outside view of an embodiment of an electronic device according to the disclosure. FIG. 2 is a partial planar outside view of an embodiment of an electronic device according to the disclosure. In an embodiment, the electronic device includes a housing 10. The housing 10 includes through holes H passing through the interior of the housing 10. A light source 30 is disposed in the housing 10. The light source 30 is disposed between a plurality of through holes H. Light is emitted by a single light source 30 through the plurality of through holes H, thereby reducing a quantity requirement and costs of light sources.

Figure 3:
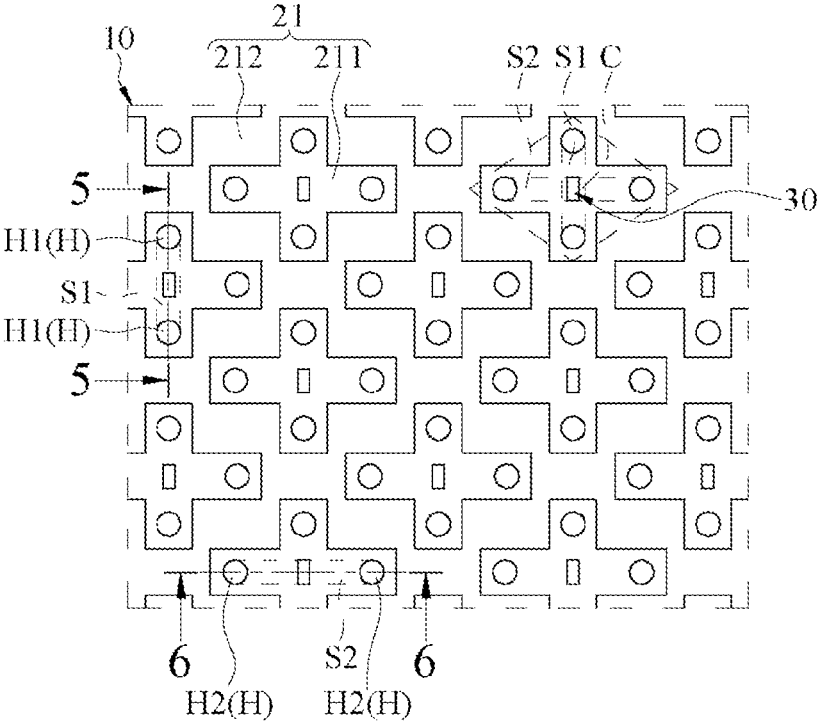
FIG. 3 is a schematic planar partial configuration view of an embodiment of an electronic device according to the disclosure.
Figure 5:
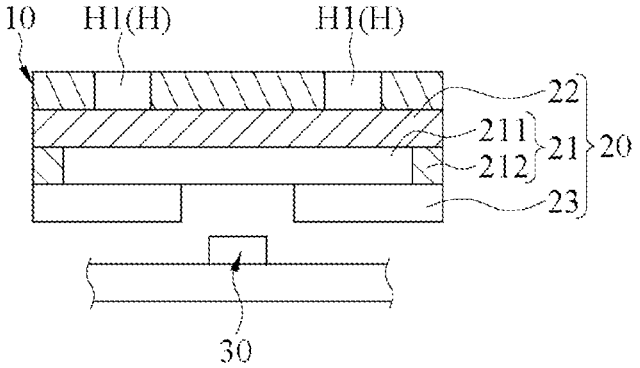
FIG. 5 is a cross-sectional view taken along line 5-5 FIG. 3.
Figure 6:
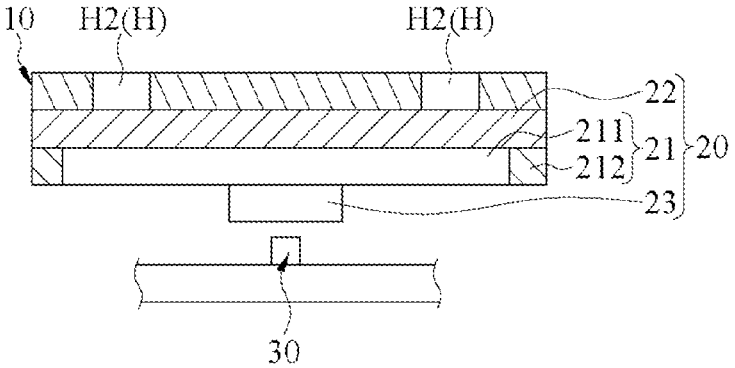
FIG. 6 is a cross-sectional view taken along line 6-6 in FIG. 3.

FIG. 5 is a cross-sectional view taken along line 5-5 in FIG. 3. FIG. 6 is a cross-sectional view taken along line 6-6 in FIG. 3. It should be noted that, FIG. 5 and FIG. 6 are used to show a stacking relationship of the layers of structure in a light guiding structure 20, but are not a presentation of an actual view angle corresponding to FIG. 3.

In an embodiment, the light guiding structure 20 disposed between the housing 10 and the light source 30 is configured to guide the light emitted by the single light source 30 to the plurality of through holes H for emission, and ensures that light emitted through the through holes H is homogenized. In an embodiment, the light source 30 is a light emitting diode (LED).

It should be noted that, for ease of describing a relative relationship of components, the accompanying drawings in the disclosure are not drawn to scale. Therefore, proportions and sizes in the accompanying drawings of the disclosure are not intended to limit the disclosure.

Referring to FIG. 1, in an embodiment, the housing 10 is applied to any of various devices that require light effects. For example, the housing is applied to a notebook computer, a tablet computer, a handheld communications device or an input/output device or any of various electronic devices.

Figure 4:
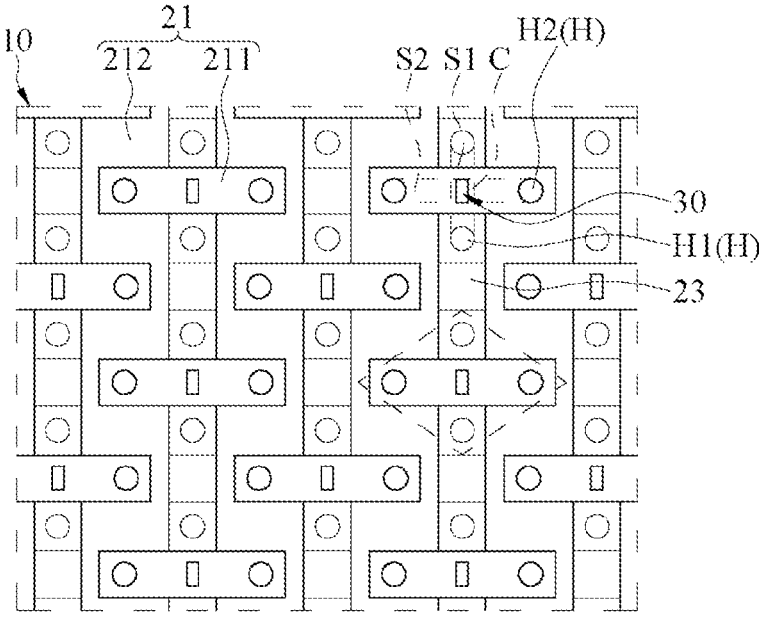
FIG. 4 is another schematic planar view of an embodiment of an electronic device according to the disclosure.

Referring to FIG. 2 to FIG. 4, FIG. 3 is a schematic planar partial configuration view of an embodiment of an electronic device according to the disclosure. FIG. 4 is another schematic planar view of an embodiment of an electronic device according to the disclosure. In an embodiment, the through holes H in the housing 10 include two first through holes H1 and two second through holes H2.

The shortest connecting line between the two first through holes H1 is a first section S1. The shortest connecting line between the two second through holes H2 is a second section S2. The length of the first section S1 is less than the length of the second section S2, and the first section S1 and the second section S2 intersect at an intersection C.

Specifically, in view of the configuration of the positions of the two first through holes H1 and the two second through holes H2, peripheral connecting lines of the two first through holes H1 and the two second through holes H2 generally form a parallelogram. In this embodiment, the first section S1 and the second section S2 are two diagonals of the parallelogram.

Referring to FIG. 2, in an embodiment, the through holes H in the housing 10 are not limited to only the two first through holes H1 and the two second through holes H2. The through holes H in the housing 10 include a plurality of first through holes H1 and a plurality of second through holes H2. The plurality of first through holes H1 and the plurality of second through holes H2 are arranged in a matrix by using the two first through holes H1 and the two second through holes H2 as a unit. Therefore, all the through holes H in the housing 10 conform the configuration of the first section S1 and the second section S2.

Referring to FIG. 5 and FIG. 6, in an embodiment, the light guiding structure 20 is disposed on a side of the housing 10, and includes a light guiding layer 21, a diffusion layer 22, and a light adjusting layer 23. The light guiding layer 21 includes a light transmitting portion 211 and a light shielding portion 212.

The position of the light transmitting portion 211 corresponds to the positions of the first section S1 and the second section S2. A portion other than the light transmitting portion 211 of the light guiding layer 21 is the light shielding portion 212, and the light transmitting portion 211 includes a first light transmission rate.

The diffusion layer 22 is disposed at the position corresponding to the light transmitting portion 211. The light adjusting layer 23 is disposed at the position corresponding to the first section S1. The light adjusting layer 23 includes a second light transmission rate, and the second light transmission rate is less than the first light transmission rate.

In addition, the light source 30 is disposed at a position that is on a side of the light guiding structure 20 and corresponds to the intersection C. Light emitted by the light source 30 passes through the light guiding structure 20 and the intersection C, and is separately emitted through the two first through holes H1 and the two second through holes H2 along the light transmitting portion 211.

In this way, the light emitted by the light source 30 passes through the diffusion layer 22, and diffuses through the light guiding structure 20. When the light passes through the light guiding structure 20, the light shielding portion 212 of the light guiding structure 20 blocks the light, so that the light only travels along the light transmitting portion 211. In this way, the light traveling along the light transmitting portion 211 simultaneously passes through the first section S1 and the second section S2 and is separately emitted through the two first through holes H1 and the two second through holes H2. Therefore, the objective of emitting the light of the single light source 30 through the plurality of through holes is achieved.

Referring to FIG. 3 and FIG. 4, because the length of the first section S1 is less than the length of the second section S2, the distance between the light source 30 and each first through hole H1 is less than the distance between the light source 30 and each second through hole H2.

When the light emitted by the light source 30 is only emitted through the first through hole H1 and the second through hole H2 along the light transmitting portion 211, the light flux of light emitted through the first through hole H1 is greater than the light flux of light emitted through the second through hole H2.

However, in the disclosure, light passing through the light transmitting portion 211 corresponding to the first section S1 also passes through the light adjusting layer 23. Therefore, partial light passing through the first section S1 is adjusted by the light adjusting layer 23, thereby reducing the light flux, and light that is near the light source 30 and therefore has relatively high light flux and light passing through the second section S2 are homogenized.

Referring to FIG. 3, in an embodiment, each first through hole H1 and each second through hole H2 are separately circular holes. A width range of the first section S1 is equal to the diameter of the first through hole H1, and a width range of the light transmitting portion 211 corresponding to the first section S1 is at least equal to the diameter of the first through hole H1.

A width range of the second section S2 is equal to the diameter of the second through hole H2, and a width range of the light transmitting portion 211 corresponding to the second section S2 is at least equal to the diameter of the second through hole H2. In this way, it is ensured that the light emitted by the light source 30 disposed at the intersection C travels and is emitted toward the first through holes H1 and the second through holes H2 without being shielded.

Referring to FIG. 3, in an embodiment, when the first through hole H1 and the second through hole H2 of the housing 10 include relatively small apertures, for ease of treatment, the width range of the light transmitting portion 211 corresponding to the first section S1 is greater than a diameter value of the first through hole H1.

The width range of the light transmitting portion 211 corresponding to the second section S2 is greater than a diameter value of the second through hole H2. Therefore, a range of the light transmitting portion 211 is increased, and treatment difficulty in arranging the light transmitting portion 211 is reduced.

After actual measurement, when the aperture of the first through hole H1 and the aperture of the second through hole H2 are both 1 mm, and the width range of the light transmitting portion 211 is increased to 1.4 mm, a light effect generated by the light that is emitted by the light source 30 through the first through hole H1 and the second through hole H2 does not change significantly and maintains the foregoing objective.

Referring to FIG. 5 and FIG. 6, the light guiding structure 20 in the embodiments in FIG. 5 and FIG. 6 is disposed by stacking the diffusion layer 22, the light guiding layer 21, and the light adjusting layer 23 in sequence. The diffusion layer 22 is close to the housing 10, and the light adjusting layer 23 is close to the light source 30.

However, if the light emitted by the light source 30 passes through the diffusion layer 22, the light guiding layer 21, and the light adjusting layer 23 before being emitted through the first through hole H1 and the second through hole H2, an objective same as the foregoing objective is achieved. Therefore, a stacking order of the diffusion layer 22, the light guiding layer 21, and the light adjusting layer 23 of the light guiding structure 20 is not limited to this embodiment.

In an embodiment, the diffusion layer 22 is an optical diffusion layer that diffuses or homogenizes the light emitted by the light source 30. An objective of homogenizing light is achieved by the diffusion layer 22 through refraction, reflection, and scattering of light. Specifically, the diffusion layer 22 is made of a light transmitting material containing light diffusion particles, for example, but not limited to, a resin substrate or a glass substrate added with light diffusion particles made of acrylic acid, barium sulfate, titanium dioxide or silicone rubber. The light diffusion particles are used to enable the light passing through the diffusion layer to generate continuous refraction and reflection, thereby changing a travel route of the light and achieving an objective of light diffusion.

In an embodiment, the diffusion layer 22 is alternatively made by directly arranging an optical micro structure on the surface of or in a light transmitting substrate, for example, but not limited to, forming a random or regular fine uneven structure on a light-transmitting resin substrate through sandblasting treatment or embossing treatment. The fine uneven structure is used to enable the light passing through the diffusion layer 22 to generate successive refraction and reflection, thereby changing a travel route of the light and achieving an objective of light diffusion.

In addition, in an embodiment, the diffusion layer 22 is a single part independent of the housing 10, or is a thin film coated on a surface, facing the light source 30, of the housing 10. In this embodiment, the diffusion layer 22 is a thin film completely coated on the surface, facing the light source 30, of the housing 10.

Referring to FIG. 3, in an embodiment, the light guiding layer 21 guides the light emitted by the light source 30 in a specific direction or to a specific position. Herein, the light guiding layer 21 includes the light transmitting portion 211 through which light passes and the light shielding portion 212 through which light does not pass. When light passes through the light guiding layer 21, the light shielding portion 212 of the light guiding layer 21 blocks the light, so that the light only passes though the light transmitting portion 211, thereby achieving an objective of guiding the light.

In an embodiment, the light guiding layer 21 is a single part independent of the housing 10, or is a thin film coated on a surface of the housing 10. In this embodiment, the light shielding portion 212 of the light guiding layer 21 is opaque ink directly coated on the diffusion layer 22. On a plane the same as the light shielding portion 212, a hollowed-out structure that is not coated with the opaque ink is the light transmitting portion 211. The light transmitting portion 211 includes a first light transmission rate. Herein, no light attenuation occurs when light passes through the light transmitting portion 211 of the hollowed-out structure, and the first light transmission rate of the light transmitting portion 211 with the hollowed-out structure is 100%.

In an embodiment, the light transmitting portion 211 of the light guiding layer 21 is not limited to the hollowed-out structure. The light transmitting portion 211 is alternatively a non-hollowed-out structure with a physical structure and a light transmission effect. In other words, the first light transmission rate of the light transmitting portion 211 is not limited to 100%.

Referring to FIG. 4, in an embodiment, the light adjusting layer 23 changes the light flux of light that passes through the light adjusting layer 23. In this embodiment, the light adjusting layer 23 is configured to change the light flux of light emitted through each first through hole H1, but is not configured to change the light flux of light emitted through each second through hole H2. Therefore, the light adjusting layer 23 is disposed at the position corresponding to the first section S1. The light adjusting layer 23 is not disposed on a portion at which the first section S1 and the second section S2 are stacked.

In an embodiment, the light adjusting layer 23 is a single part independent of the housing 10, or is a thin film coated on a surface of the housing 10. In this embodiment, the light adjusting layer 23 is a translucent thin film directly coated on the light guiding layer 21. Specifically, the light adjusting layer 23 is translucent ink.

In an embodiment, a second light transmission rate of the light adjusting layer 23 is not limited to a specific value. In this embodiment, the second light transmission rate of the light adjusting layer 23 is directly proportional to the length of the first section S1. In other words, when the length of the first section S1 is larger, the second light transmission rate of the light adjusting layer 23 is higher. When the length of the first section S1 is smaller, the second light transmission rate of the light adjusting layer 23 is lower.

In terms of a light shielding rate, a light shielding rate of the light adjusting layer 23 is inversely proportional to the length of the first section S1. In other words, when the length of the first section S1 is larger, the light shielding rate of the light adjusting layer 23 is lower. When the length of the first section S1 is smaller, the light shielding rate of the light adjusting layer 23 is higher.

Figure 7:
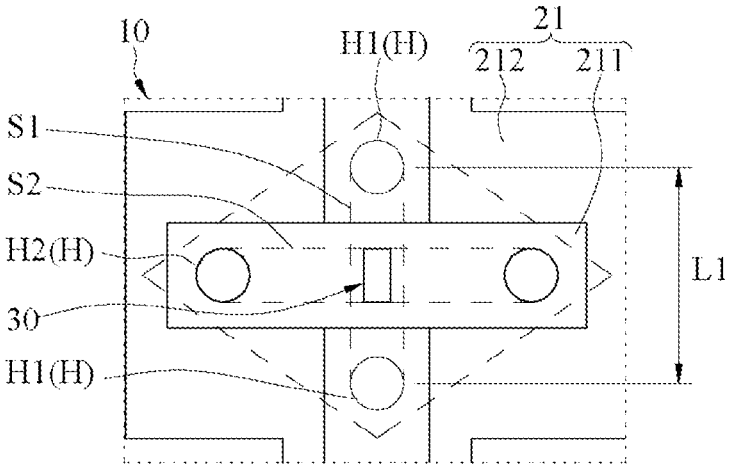
FIG. 7 is a schematic enlarged partial configuration view of an embodiment of an electronic device according to the disclosure.
Figure 8:
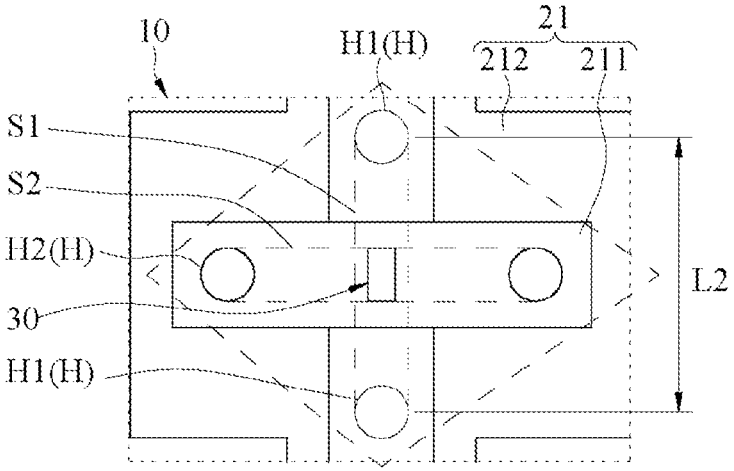
FIG. 8 is another schematic partial configuration enlarged view of an embodiment of an electronic device according to the disclosure.

In an embodiment, FIG. 7 is a schematic enlarged partial configuration view of an embodiment of an electronic device according to the disclosure. FIG. 8 is another schematic partial configuration enlarged view of an embodiment of an electronic device according to the disclosure. The length of the second section S2 in FIG. 7 is the same as that in FIG. 8. The first section S1 in the embodiment in FIG. 7 includes a first length L1, and the first section S1 in the embodiment in FIG. 8 includes a second length L2. The second length L2 is greater than the first length L1. Herein, a light transmission rate of the light adjusting layer 23 in the embodiment in FIG. 7 needs to be less than a light transmission rate of the light adjusting layer 23 in the embodiment in FIG. 8. The light shielding rate of the light adjusting layer 23 in the embodiment in FIG. 7 needs to be greater than the light shielding rate of the light adjusting layer 23 in the embodiment in FIG. 8.

In an embodiment, when the light guiding layer 21, the diffusion layer 22, and the light adjusting layer 23 of the light guiding structure 20 are all single structures independent of the housing 10. The light guiding layer 21, the diffusion layer 22, and the light adjusting layer 23 are bonded by a light-transmitting optical adhesive. The optical adhesive is, but is not limited to, an optically clear adhesive (OCA) or optically clear resin (OCR). Therefore, distances between the light guiding layer 21, the diffusion layer 22, and the light adjusting layer 23 are adjusted according to the thickness of the optical adhesive, so that it is easy to control a refraction process of light emitted by the light source 30 in the light guiding structure 20.

In an embodiment, the electronic device further includes dust-proof structures. The dust-proof structures are disposed in the first through holes H1 and the second through holes H2. Herein, the dust-proof structures are made of a light-transmitting material. Specifically, the dust-proof structures are, but are not limited to, lenses or light-transmitting plastic materials. Therefore, the light-transmitting dust-proof structures implements a dust-proof function without affecting the emission of light.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. An electronic device, comprising:

a housing, comprising two first through holes and two second through holes, wherein a first section is provided between the two first through holes, a second section is provided between the two second through holes, the length of the first section is less than the length of the second section, and the first section and the second section intersect at an intersection;

a light guiding structure, disposed on a side of the housing, and comprising:

a light guiding layer, comprising a light transmitting portion and a light shielding portion, wherein the light transmitting portion corresponds to the positions of the first section and the second section, a portion other than the light transmitting portion is the light shielding portion, and the light transmitting portion comprises a first light transmission rate;

a diffusion layer, disposed at the position corresponding to the light transmitting portion; and a light adjusting layer, disposed at the position corresponding to the first section, wherein the light adjusting layer comprises a second light transmission rate, and the second light transmission rate is less than the first light transmission rate; and a light source, disposed at a position that is on a side of the light guiding structure and corresponds to the intersection, wherein light emitted by the light source passes through the light guiding structure and the intersection, and is separately emitted through the two first through holes and the two second through holes along the light transmitting portion;

wherein the diffusion layer is disposed between the housing and the light source.

2. The electronic device according to claim 1, wherein the light shielding portion of the light guiding layer is opaque ink.

3. The electronic device according to claim 2, wherein the light transmitting portion is a hollowed-out structure.

4. The electronic device according to claim 1, wherein the light adjusting layer is translucent ink.

5. The electronic device according to claim 1, wherein the light guiding layer, the diffusion layer, and the light adjusting layer are stacked with each other.

6. An electronic device, comprising:

a housing, comprising two first through holes and two second through holes, wherein a first section is provided between the two first through holes, a second section is provided between the two second through holes, the length of the first section is less than the length of the second section, and the first section and the second section intersect at an intersection;

a light guiding structure, disposed on a side of the housing, and comprising:

a light guiding layer, comprising a light transmitting portion and a light shielding portion, wherein the light transmitting portion corresponds to the positions of the first section and the second section, a portion other than the light transmitting portion is the light shielding portion, and the light transmitting portion comprises a first light transmission rate;

a diffusion layer, disposed at the position corresponding to the light transmitting portion; and a light adjusting layer, disposed at the position corresponding to the first section, wherein the light adjusting layer comprises a second light transmission rate, and the second light transmission rate is less than the first light transmission rate; and a light source, disposed at a position that is on a side of the light guiding structure and corresponds to the intersection, wherein light emitted by the light source passes through the light guiding structure and the intersection, and is separately emitted through the two first through holes and the two second through holes along the light transmitting portion; and a plurality of dust-proof structures, disposed in the first through holes and the second through holes.

7. The electronic device according to claim 6, wherein the dust-proof structures are lenses.

8. The electronic device according to claim 6, wherein the dust-proof structures are light-transmitting plastic materials.

9. The electronic device according to claim 1, wherein the light guiding layer, the diffusion layer, and the light adjusting layer of the light guiding structure are bonded by a light-transmitting optical adhesive.

* * * * *